US005254963A

United States Patent [19]

Bonetti et al.

[11] Patent Number: 5,254,963

[45] Date of Patent: Oct. 19, 1993

[54] MICROWAVE FILTER WITH A WIDE SPURIOUS-FREE BAND-STOP RESPONSE

[75] Inventors: Rene R. Bonetti, Gaithersburg; Albert E. Williams, Bethesda, both of Md.

[73] Assignee: COMSAT, Washington, D.C.

[21] Appl. No.: 765,274

[22] Filed: Sep. 25, 1991

[51] Int. Cl.[5] ..... H01P 1/208; H01P 5/12

[52] U.S. Cl. ..... 333/208; 333/135; 333/212

[58] Field of Search ..... 333/135, 137, 208–212, 333/227, 228, 230; 370/72, 69.1

[56] References Cited

U.S. PATENT DOCUMENTS

| | | | |
|---|---|---|---|
| 4,267,537 | 5/1981 | Karmel | 333/231 |
| 4,410,865 | 10/1983 | Young et al. | 333/208 |
| 4,489,293 | 12/1984 | Fiedziuszko | 333/202 |
| 4,540,960 | 9/1985 | Giordano | 333/228 |
| 4,614,920 | 9/1986 | Tong | 333/135 |
| 4,622,523 | 11/1986 | Tang | 333/28 R |
| 4,630,009 | 12/1986 | Tang | 333/28 R |
| 4,644,305 | 2/1987 | Tang et al. | 333/208 |
| 4,734,665 | 3/1988 | Rosenberg et al. | 333/212 |
| 4,777,459 | 10/1988 | Hudspeth | 333/135 |
| 4,792,771 | 12/1988 | Siu | 333/212 X |
| 4,996,506 | 2/1991 | Ishikawa et al. | 333/219.1 |

FOREIGN PATENT DOCUMENTS

| | | | |
|---|---|---|---|
| 0099547 | 8/1979 | Japan | 323/209 |
| 0014503 | 1/1985 | Japan | 333/212 |

*Primary Examiner*—Steven Mottola
*Assistant Examiner*—Seung Ham
*Attorney, Agent, or Firm*—Sughrue, Mion, Zinn, Macpeak & Seas

[57] ABSTRACT

The present invention is directed to reducing the number of components required to minimize intermodulation distortion within the wide transmission frequency band used by a satellite communications repeater system. In particular, at least two $TM_{010}$ mode cavity is cascaded to a plurality of $TE_{113}$ mode cavities to form a narrow band-pass, wide band-stop filter for receiving and outputting channel signals to the multiplexer manifold of a satellite repeater. The filter thus constructed realizes the narrow band-pass response required in microwave communications, while eliminating the spurious resonance frequencies normally eliminated by additional filter components. In this manner, the size and weight considerations of the satellite system are improved without loss in performance.

12 Claims, 8 Drawing Sheets

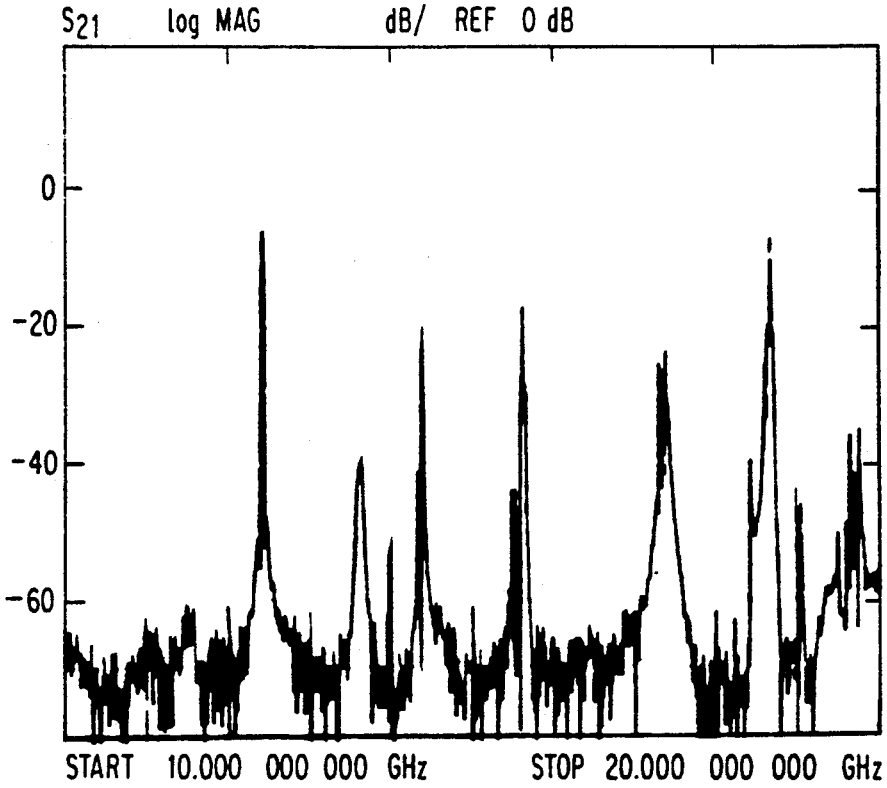
FIG. 9a
Prior Art
FIG. 9b
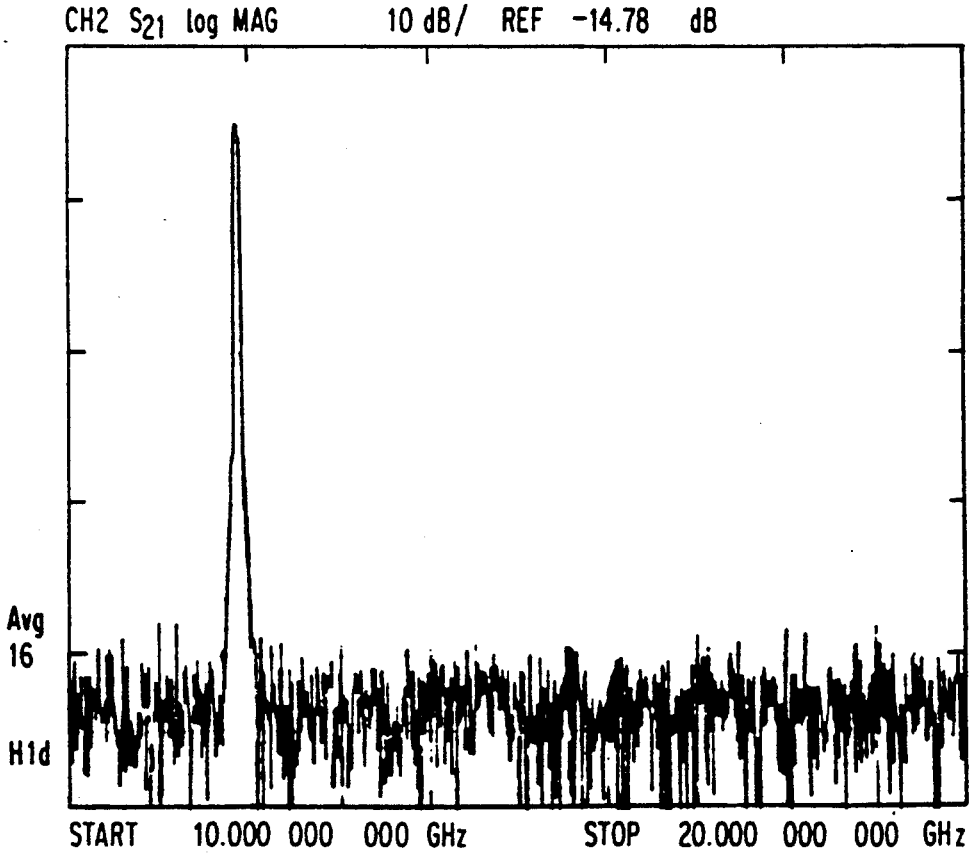

MICROWAVE FILTER WITH A WIDE SPURIOUS-FREE BAND-STOP RESPONSE

FIELD OF THE INVENTION

The present invention relates to the field of microwave communications. More specifically, the present invention is directed to a satellite repeater system having an output filter which realizes a narrow band-pass and a wide band-stop response The technique significantly reduces in size and weight of technique combinations typically used in conventional satellite repeaters by eliminating the need of a low-pass filler in cascade with narrowband filters.

BACKGROUND OF THE INVENTION

Microwave communications systems require filters with sharp frequency selectivity characteristics. These characteristics must be realized in devices of minimum weight and volume in order to be useful in microwave applications such as satellite communications. Conventional satellite communications systems employ multiplexing systems based upon wave-guide, band-pass filters. Such filters represent a significant percentage of the overall system weight. High-capacity satellite communication systems usually distribute the signal power over the communication band of the system. In order to utilize the allocated frequency spectrum as efficiently as possible, guard bands should be kept very narrow and, hence, sharp cut-off filters are required.

At microwave frequencies, it is natural to utilize the tuned cavity of a wave-guide as one of the basic circuit elements in filter design. The dimensions of each cavity are determined by the desired center frequency of the band-pass filter. At the center frequency, the electrical length of each cavity must be equal to one-half or multiples of the guide wavelength for the particular mode under consideration.

A mode is the shape or configuration of a field (either electric or magnetic) in the cavity. In general, to produce the desired response from a filter, a cavity is configured to allow the passage of only a particular mode of the cavity's resonant frequency. The electromagnetic energy, restricted to this mode, emerges from the filter with the desired response.

Complex frequency responses can be realized with a minimum of additional cavities by using cavities designed to resonate in a plurality of modes, as shown by Atia et al., "New Types of Waveguide Bandpass Filters," *Comsat Technical Review*, Vol. 1, No. 1, Fall 1971, pp. 21–43, which is hereby incorporated by reference. For example, a dual-mode filter that initially resonates in a first mode has that first mode tuned or perturbed to create a second mode. The second mode differs from the first only in that the direction of its field is orthogonal to the field of the first mode. Through the use of such multiple-mode cavities, electromagnetic energy can be affected by a cavity's filter characteristic a plurality of times in one cavity rather than only once. As a result, the number of cavities necessary to produce the desired response can be reduced by one-half the number of corresponding single-mode sections required. The perturbation of the field in the first mode to produce a second orthogonal mode is generally called "coupling." Coupling invariably is caused by structural discontinuities in the cavity, such as screws positioned on its wall that perturb the field of the first mode. Coupling techniques are well known in the art. U.S. Pat. Nos. 4,410,865 and 4,734,665 provide examples of such techniques.

The resonant circuits of the microwave filters can be realized by the transverse electric (TE) or transverse magnetic (TM) modes which oscillate in resonance in the individual cavity resonators. The use of TE and TM modes to facilitate microwave communications in satellite systems is well known. U.S. Pat. Nos. 4,267,537, 4,489,293, 4,622,523, and 4,644,305, which are hereby incorporated by reference, each disclose the use in microwave filters used in satellite systems. Satellite systems often employ a number of directive antennas receiving signals at different frequencies. The signals received by the antennas are typically combined via microwave multiplexers. The multiplexer outputs the signals in a common channel of broader bandwidth, typically 500 MHz or more. Such multiplexer designs are well known in the art; U.S. Pat. Nos. 4,614,920 and 4,777,459 provide some examples.

FIG. 1 illustrates a conventional satellite communication repeater system. The output multiplexer section 5 consists of a set of high quality factor (Q) wave-guide cavities. In this particular example, the system is composed of five channels (shown in FIG. 2*a*), each designed to realize a six-pole, quasi-elliptic response. Each channel employs a narrow band-pass filter 21, 23, 25, 27 or 29 consisting of three dual-mode $TE_{113}$ cavities. A series of low-pass filters 20, 22, 24, 26 and 28 are coupled to the input of each channel so as to suppress any potential higher order spurious transmission within the repeater.

In operation, an input multiplexer 2 (FIG. 1) divides or splits a band of signals received by receiving section 1 into a number of narrow-band frequency channels, e.g., 36 or 76 MHz. Separate high power amplifiers (within section 4) are used to amplify respective channel signals for input to the output multiplexer section 5. Each amplifier outputs signals to an associated low-pass filter (20, 22, 24, 26 or 28) which removes all high frequency noise signals from the channel, and outputs the filtered signal to an associated narrow band-pass filter 21, 23, 25, 27 or 29. Each narrow band-pass filter is designed to receive frequencies in the $TE_{113}$ mode. Three dual-mode cavities are cascaded together to produce a wide-band response like that shown in FIG. 9*a*.

Each narrow band-pass filter output is coupled through a T-junction to a wave-guide manifold 36 (FIG. 2*a*). The output signals are summed together by the manifold to form a common output channel, and connected to an antenna for transmission to a ground station.

A major drawback of the repeater system shown in FIG. 1 is the use of a separate set of low-pass filters to separate the spurious noise from the input signal of each channel prior to the narrow band-pass filtering. The set of filters adds weight and components to the satellite system. Furthermore, the dual-mode wave-guide cavities have poor wide-band responses. That is, unwanted frequencies beyond the cavity's center frequency tend to appear, which causes the transmission response to become less predictable.

Thus, it is desirable to design a satellite repeater system with an output multiplexer filter which realizes a narrow bandpass response, but does not require additional components to be added to the system in order to produce a spurious-free wideband response.

SUMMARY OF THE INVENTION

The principal object of the present invention is to reduce the size, weight, and number of components in a satellite repeater system by eliminating the need for a separate low-pass filter at the output of the repeater.

A further object of the present invention is to replace the prior art low-pass/narrow band-pass filter combination with a single filter design that realizes both a narrow band-pass and also a wide band-stop response.

The present invention achieves the foregoing objects by providing a filter that is composed of at least two transverse magnetic (TM) mode cavities cascaded with a plurality of transverse electric (TE) dual mode cavities. The cavities may be cylindrical in shape to resonate in a circular cavity mode. Specifically, a pair of single-mode $TM_{010}$ cavities having a diameter-to-length ratio greater than 3.0 are coupled with two dual-mode cavities cascaded together that resonate in the $TE_{113}$ mode. The only potential spurious mode up to twice the operating frequency is the $TM_{110}$. Although suppression of the next higher TM mode, $TM_{210}$, would be helpful, such suppression is not necessary.

The above and other objects, features, and advantages of the present invention can be derived from the following description of the preferred embodiment.

BRIEF DESCRIPTION OF THE DRAWINGS

The structure, operation, and advantages derived from the present invention can be better understood by reference to the following drawings.

FIG. 9*a* illustrates the wide-band response of a conventional $TE_{113}$ dual-mode, six-pole filter.

FIG. 9*b* illustrates the wide-band response of a six-pole filter in accordance with the present invention.

DETAILED DESCRIPTION OF THE PREFERRED EMBODIMENT(S)

Figure 2A:
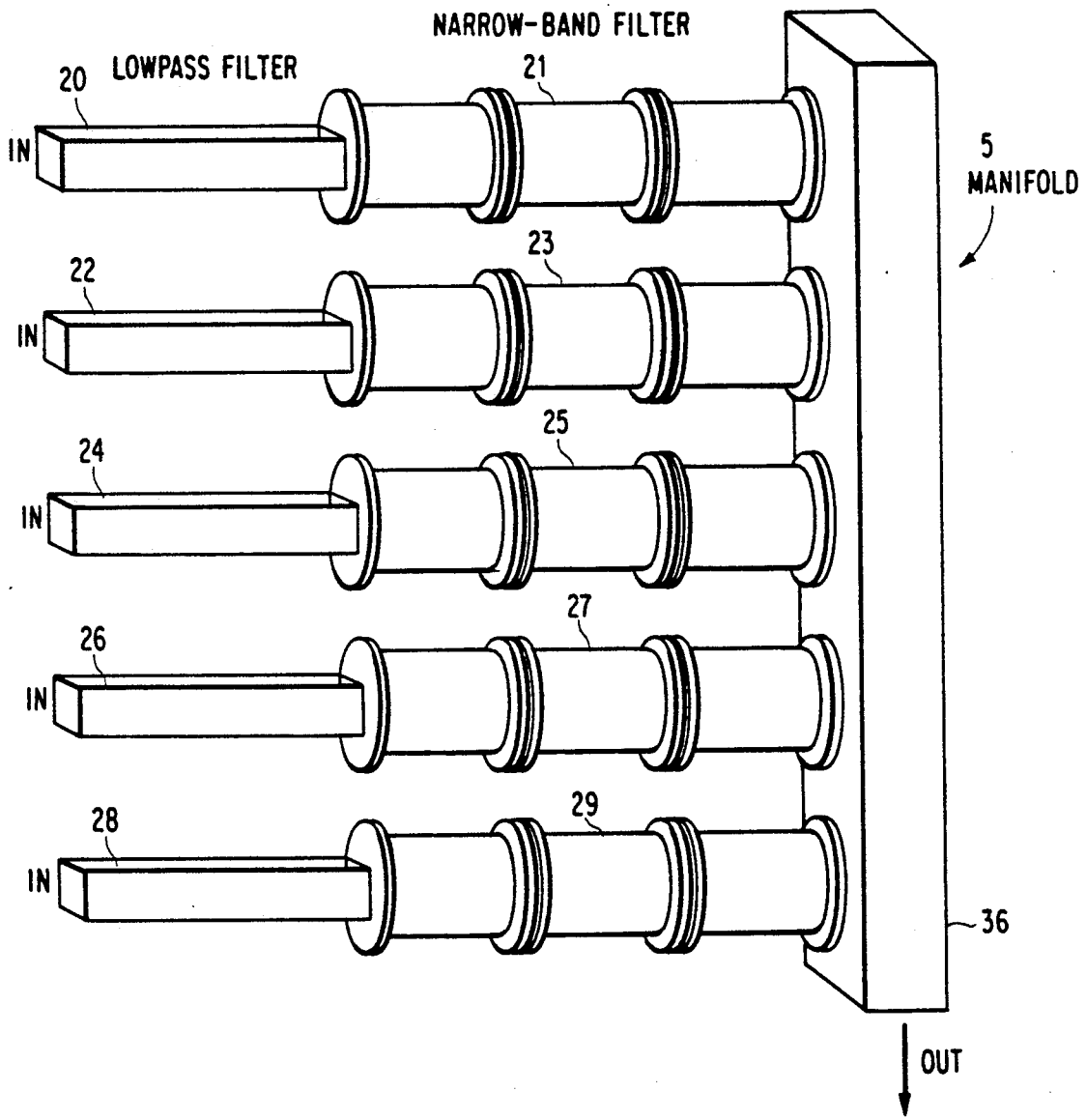
FIG. 2a Prior Art
FIG. 2*a* illustrates a conventional output multiplexer arrangement used in the output multiplexer section of the system depicted in FIG. 1.
Figure 2B:
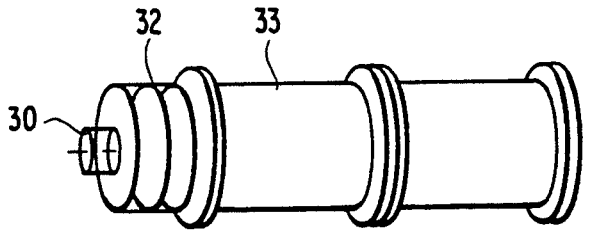
FIG. 2*b* illustrates the narrow band-pass, wide band-stop filter according to the present invention.

In the present invention the conventional narrow band-pass filters 21, 23, 25, 27 and 29 (FIG. 2*a*) are each replaced by a plurality of dual-mode transverse electric (TE) cavities, forming section 33 (FIG. 2*b*), the operation of which is well known in the art and need not be discussed in detail herein. In the preferred embodiment two TE cavities 33 are cascaded together and resonate in the well known $TE_{113}$ mode for each channel of the repeater system. The output of the cascaded cavities are input to manifold 36 (FIG. 2*a*) in a manner similar to that described above.

Figure 3:
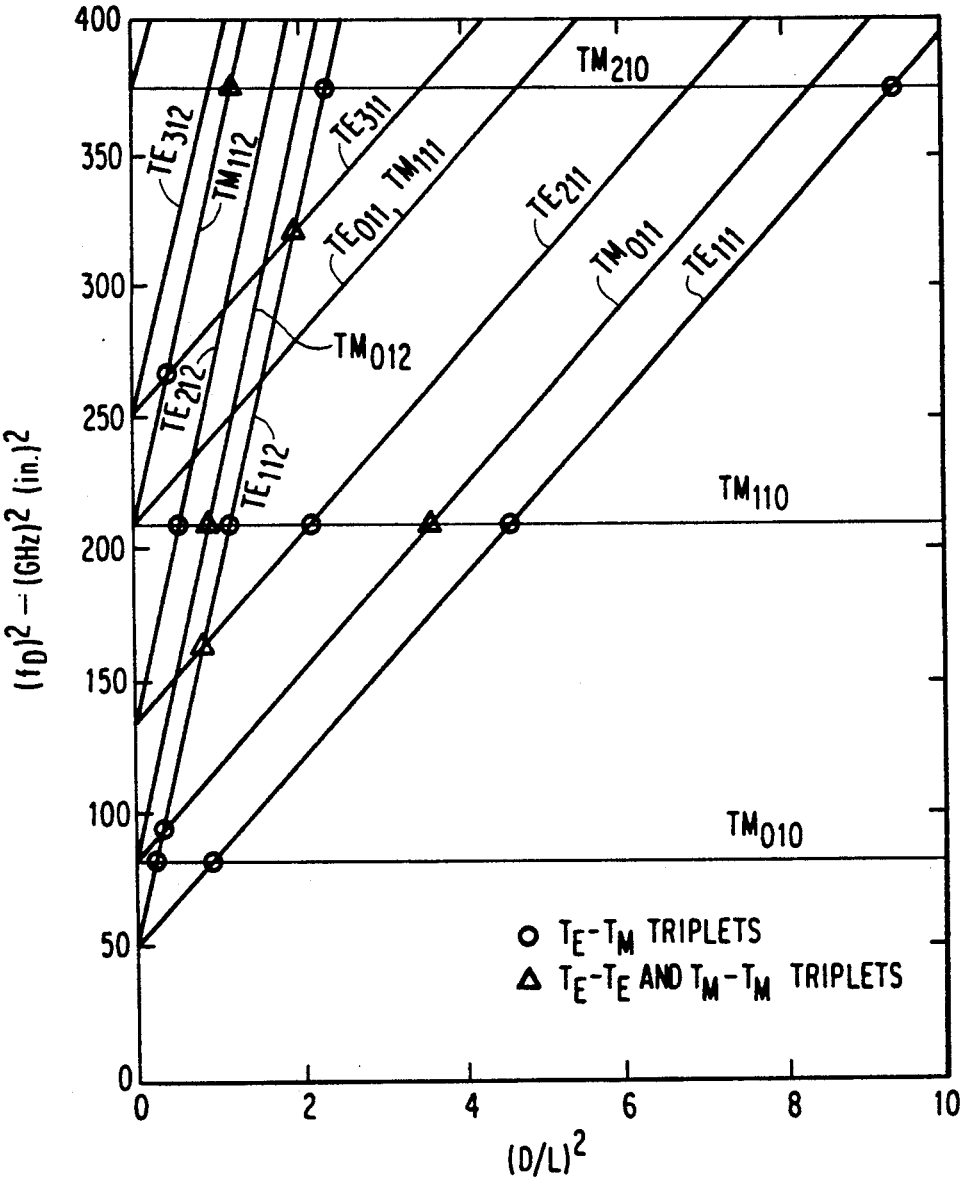
FIG. 3 illustrates a mode chart used in determining the dimensions of a circular cylinder resonator used in the present invention.

Channel signals are input to the cascaded cavities from at least one transverse magnetic (TM) mode resonating cavity. In the preferred embodiment, two circular TM cavities 32 (FIG. 2*b*) are used in the filter design. Most preferably, each cavity is constructed to resonate in the $TM_{010}$ mode, which is found to have the potential for second harmonic spurious rejection. As shown in FIG. 3, the diameter-to-length ratio greater than 3.0 leaves the only potential spurious mode up to twice the operating frequency (i.e., 12 GHz), is the $TM_{110}$ mode. Suppression of the next higher TM mode, the $TM_{210}$ mode, would aid in eliminating most of the intermodulation distortion, but is not necessary.

Figure 1:
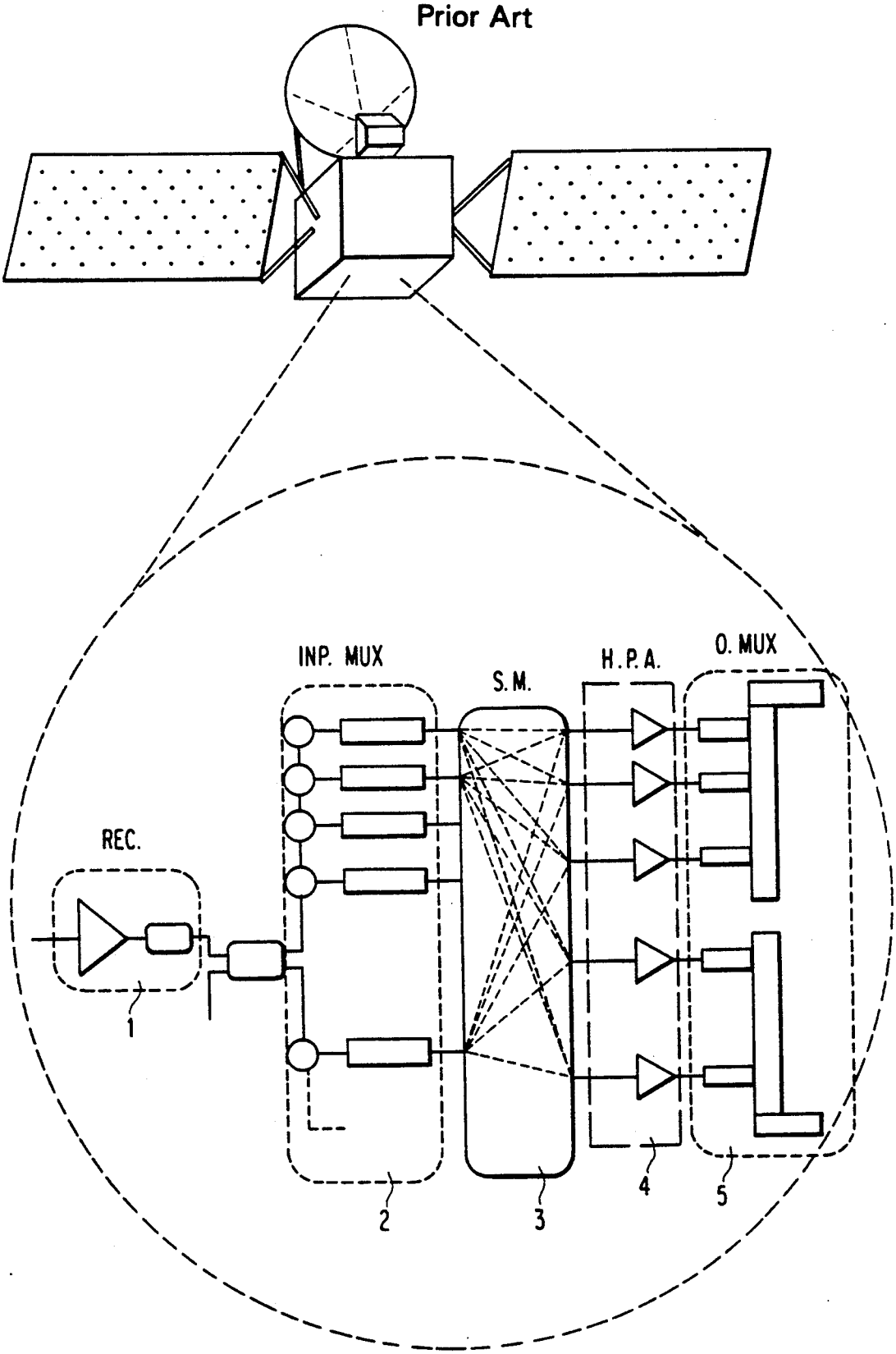
FIG. 1 Prior Art
FIG. 1 illustrates a block diagram of a conventional satellite communications system.

The use of the $TM_{010}$ mode has a slight disadvantage in that it results in an unloaded Q of about 3000 at 12 GHz, compared to a Q of 13000 for a conventional dual-mode $TE_{113}$ construction. Nevertheless, if only one or two TM cavities (32*a*, 32*b*) are used in a higher order filter, e.g., six- or eight-pole filter, then the average unloaded Q of such a structure does not lead to a loss greater than that of the standard configuration shown in FIGS. 1 and 2*a* (described above).

Figure 5A:
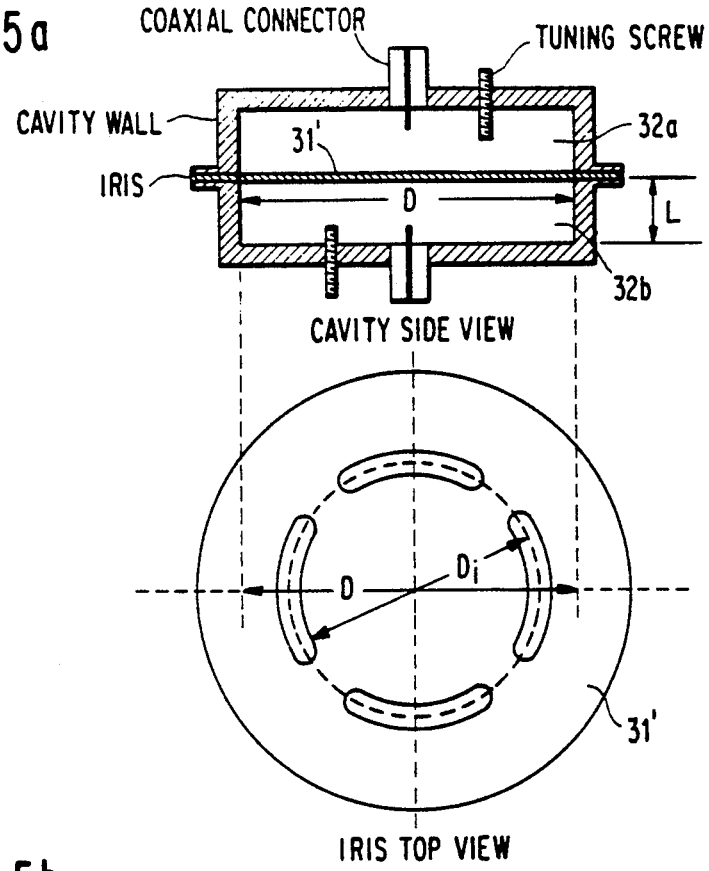
FIG. 5*a* illustrates a four-iris structured aperture that is used to separate the two $TM_{010}$ cavities of the filter in accordance with another aspect of the present invention.
Figure 6:
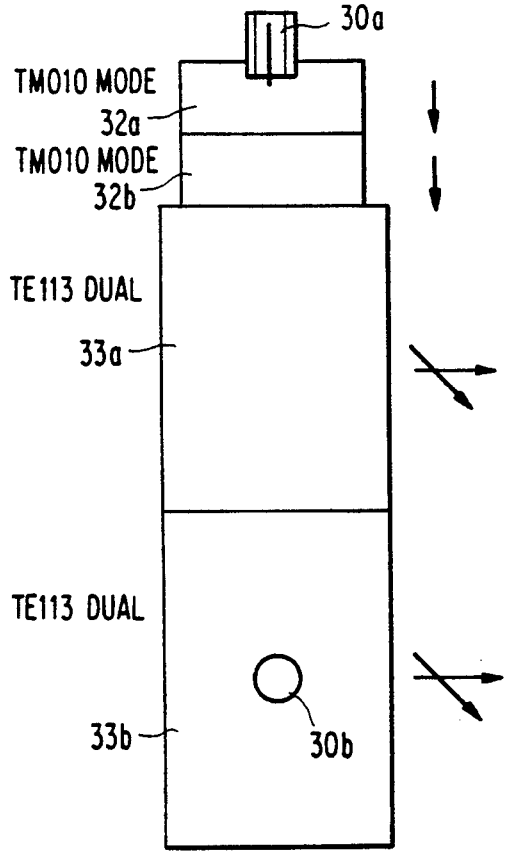
FIG. 6 illustrates the narrow band-pass, wide band-stop filter construction according to the present invention.

As shown in FIG. 6, the two $TM_{010}$ cavities are cascaded with a plurality of dual-mode $TE_{113}$ cavities. Coupling into the filter is via a center coaxial probe 30*a* in the first $TM_{010}$ cavity and in the last dual-mode $TE_{113}$ cavity 30*b*. The filter employs standard coupling between the $TE_{113}$ modes such as screw and slotted iris techniques shown in U.S. Pat. Nos. 4,630,009, 4,792,771, or any other techniques as may be well known in the art. However, the filter makes use of a spurious free TM apertures to couple the $TM_{010}$ cavities. The preferred aperture takes the form of a four-iris structure 31', as shown in FIG. 5*a*. A single angular iris couples the second TM cavity 32*b* to the first TM cavity 32*a*.

Figure 4A:
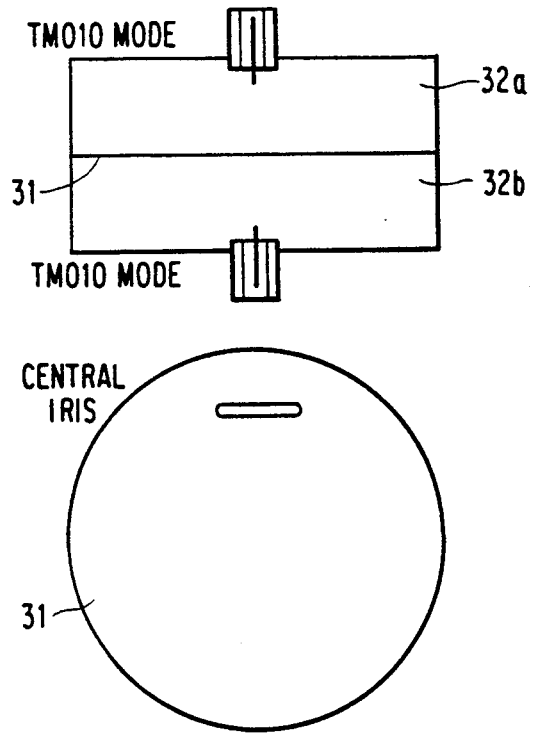
FIG. 4*a* illustrates the two-cavity $TM_{010}$ section of the filter of the present invention using a conventional iris aperture.
Figure 4B:
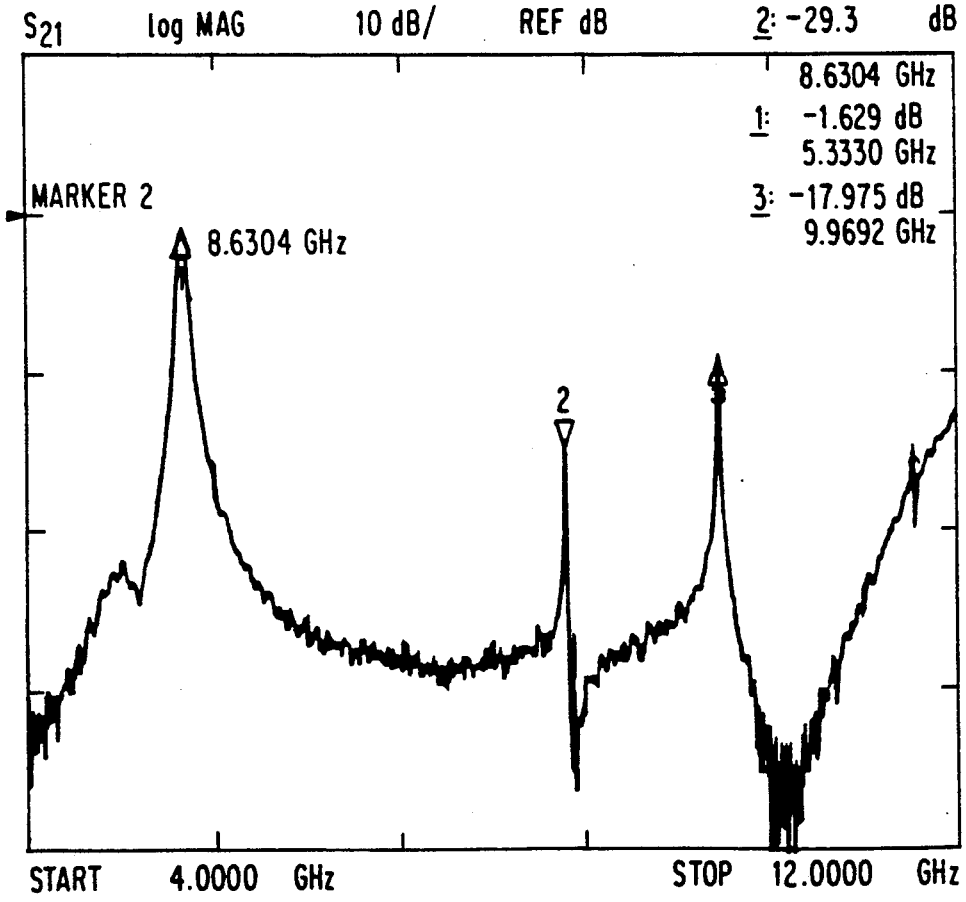
FIG. 4*b* illustrates the frequency response of the section depicted in FIG. 4*a*.
Figure 5B:
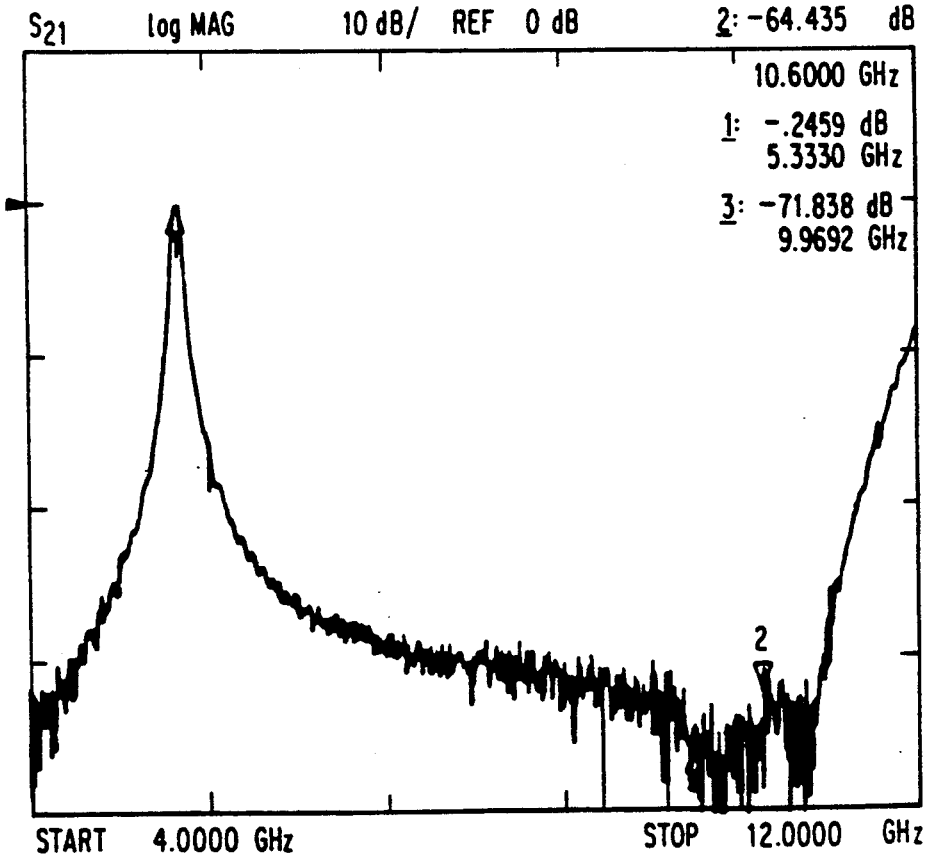
FIG. 5*b* illustrates the frequency response of the section depicted in FIG. 5*a*.

The four-iris 31' structure has radii chosen to minimize the coupling of the theta component of the magnetic field during the $TM_{210}$ mode to give the best wide band-stop performance. FIG. 5*b* illustrates the wide-band response using the four-iris structure. The structure is an improvement of the response illustrated in FIG. 4*b*, which results from the use of conventional iris 31 (FIG. 4*a*).

Figure 7:
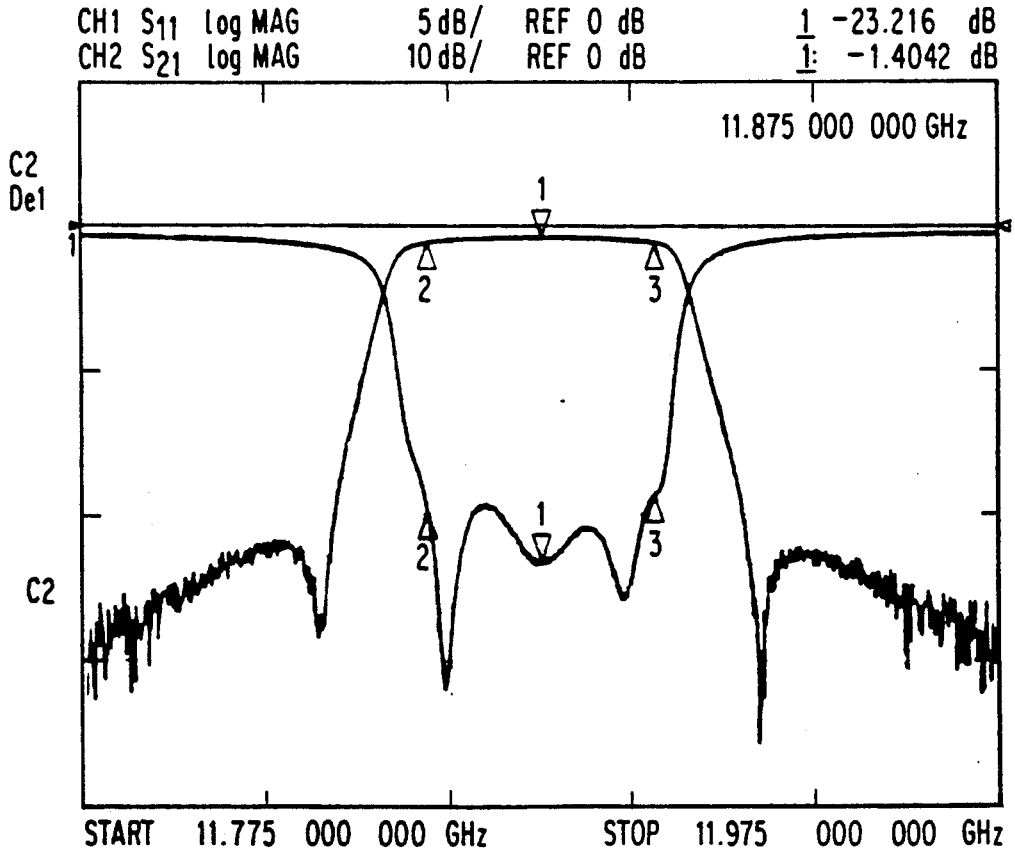
FIG. 7 illustrates the frequency response corresponding to the filter depicted in FIG. 6.
Figure 8A:
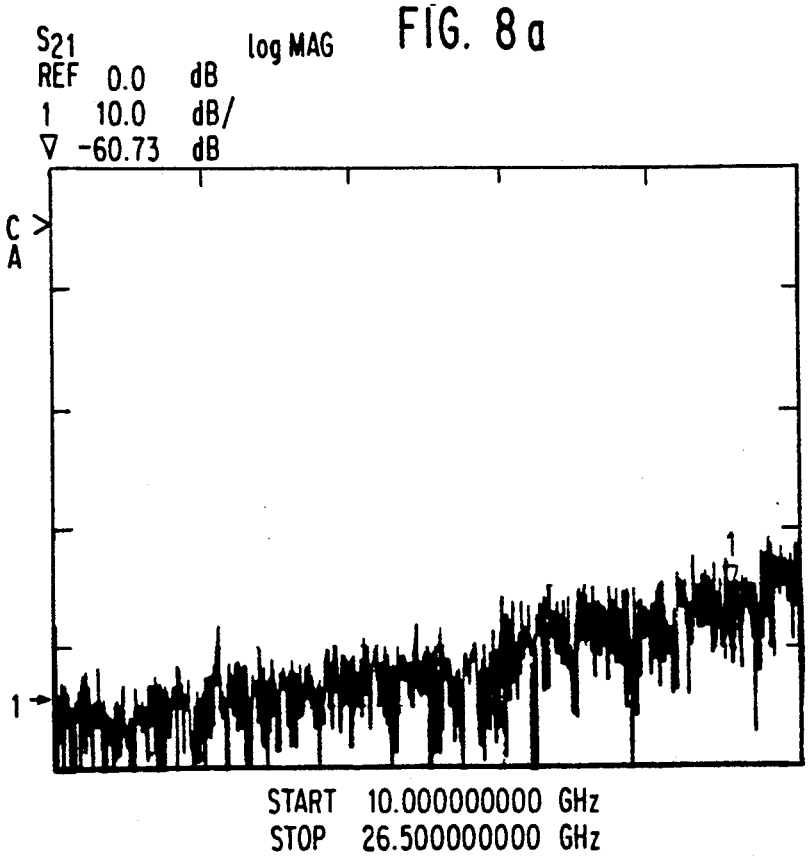
FIG. 8*a* illustrates the noise level of the environment used to test the frequency response of the filter.
Figure 8B:
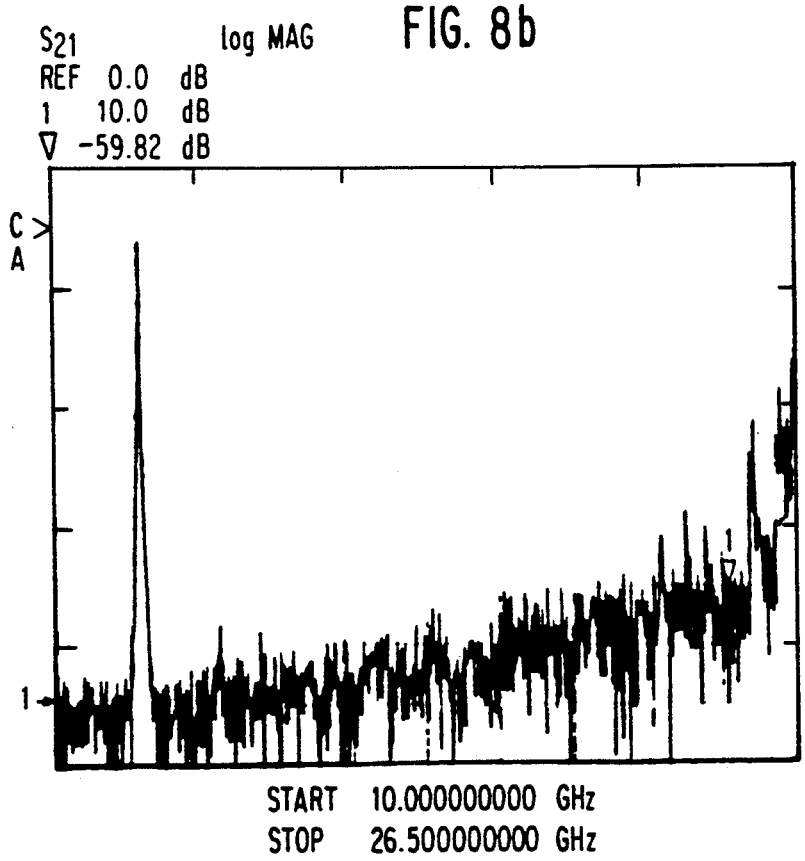
FIG. 8*b* illustrates the frequency response of the wide band-stop portion of the filter shown in FIG. 6.

The filter thus described and shown in FIG. 6 realizes a narrow-band electrical performance of a six-pole, quasi-elliptical filter. The response of the filter is shown in FIG. 7. The wide band-stop response is shown in FIG. 8*b*. Spurious rejection of greater than 50 dB is achieved out to about 25 GHz. The superior electrical transmission performance of this filter to 20 GHz (FIG. 9*b*) is compared to the response of a conventional six-pole $TE_{113}$ mode filter in FIGS. 9*a* .

In accordance with the present invention thus described, the conventional satellite repeater system (FIGS. 1 and 2*a*) can be improved by replacing the low-pass/narrow band-pass filter combination with a single multiplexer narrow band-pass, wide band-stop filter (FIGS. 2*b* and 6*a*) that can realize an improved electrical response as compared to the conventional systems, without adding additional components.

Other modifications and variations to the invention will be apparent to those skilled in the art from the foregoing disclosure and teachings. Thus, while only certain embodiments of the invention have been specifically described herein, it will be apparent that numerous modifications may be made thereto without departing from the spirit and scope of the invention.

What is claimed is:

1. An output filter having a narrow band-pass and wide band-stop response, the output filter comprising:

at least two single-mode transverse magnetic (TM) wave-guide cavities that resonate in a $TM_{010}$ mode;

a plurality of wave-guide cavities that resonate in transverse electric (TE) modes cascaded with one of said at least two $TM_{010}$ cavities; and an iris disposed between said at least two $TM_{010}$ cavities, wherein said iris has four arcuate aperture sections that provide for coupling between said at least two $TM_{010}$ cavities so as to eliminate spurious signals in the wide band-stop response of the output filter.

2. The output filter of claim 1, wherein said filter realizes a six-pole, elliptical response.

3. The output filter of claim 2, wherein said filter thus formed has a 55 MHz band-pass response, and rejects spurious signals greater than 50 dB.

4. The output filter of claim 3, wherein said at least two single-mode $TM_{010}$ cavities have a diameter-to-length ratio greater than 3.0.

5. The output filter of claim 1, wherein said plurality of TE cavities are dual-mode TE cavities that resonate in a $TE_{113}$ mode.

6. A communication satellite repeater system having a frequency divider circuit splitting a frequency band into a plurality of frequency channels, which are each amplified by a separate power amplifier, said channels being combined together by a multiplexer thereafter and connected to an antenna for transmission to a ground station, said repeater system further comprising:

a plurality of filters each comprising a plurality of single-mode transverse magnetic (TM) cavities resonating in a $TM_{010}$ mode cascaded to a plurality of transverse electric (TE) cavities, each of said plurality of filters being positioned to receive a portion of the split frequency band corresponding to a respective one of said plurality of frequency channels, said filters outputting respective filtered signals to respective power amplifiers prior to combining by said multiplexer, said plurality of $TM_{010}$ cavities for each of said plurality of filters being coupled together by at least one iris having a plurality of arcuate-shaped aperture sections to reject spurious frequencies in the $TM_{010}$ mode, thereby forming a filter having a spurious-free wide band-stop response.

7. The system of claim 6, wherein said plurality of TM cavities have a diameter-to-length ratio greater than 3.0.

8. The system of claim 7, wherein said iris has a four-aperture structure for suppressing extraneous modes within a respective filter.

9. The system of claim 6, wherein said plurality of TE cavities resonate in a $TE_{113}$ mode.

10. A method of filtering a signal comprising the steps of:

inputting a first signal into at least two single-mode transverse magnetic mode cavities that resonate in a $TM_{010}$ mode, said cavities being separated by an iris having a plurality of arcuate-shaped aperture sections, said cavities having a diameter-to-length ratio greater than 3.0;

resonating said first signal and outputting a second signal from said at least two $TM_{010}$ mode cavities;

inputting said second signal into a first of a cascade of transverse electric (TE) cavities; and outputting a filtered signal from said cascade of TE cavities so as to reject spurious frequencies.

11. The method of claim 10, wherein said method of filtering is effective to reject spurious signals greater than 50 db.

12. The method of claim 11, wherein said second signal resonates in said TE cavities in a $TE_{113}$ mode.

* * * * *